United States Patent [19]

Kuboki et al.

[11] Patent Number: 4,935,069

[45] Date of Patent: Jun. 19, 1990

[54] METHOD FOR WORKING NICKEL-BASE ALLOY

[75] Inventors: Isao Kuboki; Kenzo Kato; Shunji Watanabe, all of Tokyo, Japan

[73] Assignee: Seiko Instruments Inc., Japan

[21] Appl. No.: 241,355

[22] Filed: Sep. 7, 1988

[30] Foreign Application Priority Data

Sep. 10, 1987 [JP] Japan ..... 62-227369

[51] Int. Cl.[5] ..... C22C 1/10

[52] U.S. Cl. ..... 148/11.5 N; 148/428; 420/902

[58] Field of Search ..... 148/11.5 N, 410, 428; 420/902

[56] References Cited

U.S. PATENT DOCUMENTS 4,762,681 8/1988 Tassen et al. ..... 148/428

*Primary Examiner*—R. Dean

*Attorney, Agent, or Firm*—Bruce L. Adams; Van C. Wilks

[57] ABSTRACT

An hard ornamental alloy can be obtained by subjecting a nickel-base alloy to cold working, warm working or both workings at a working reduction of 35% or above and then subjecting it to hot working at 800° to 1000° C. and at a strain rate of from $10^{-5}S^{-1}$ to $10°S^{-1}$.

7 Claims, 1 Drawing Sheet

METHOD FOR WORKING NICKEL-BASE ALLOY

BACKGROUND OF THE INVENTION (1) Field of the Invention

The present invention relates to a method for working a nickel-base alloy and more particularly to a thermomechanical treatment which is able to introduce superplasticity to the alloy. (2) Description of the Related Art It is known that γ-precipitation hardening-type nickel-base alloys cannot be forged on account of their extremely high strength, their recrystallization temperature close to their melting point, and their extremely low ductility, and consequently they are formed by precision casting, whereas they exhibit superplasticity and enhanced ductility when their crystal grains are reduced in size. A nickel-base alloy of fine crystal grains is produced by powder metallurgy because it is impossible to reduce the size of crystal grains by ordinary melt casting. Recently, a nickel-base alloy having fine crystal grains has been produced by the roll method which includes the step of pouring a molten metal onto the surface of a roll running at a high speed.

The superplasticity of a nickel-base alloy manifests itself when it is composed of fine crystal grains. The finer the crystal grains, the better the characteristic properties of the alloy. The grain refinement is not achieved by the conventional powder metallurgy, and a structure of fine grains can be obtained only by large-scale preforming such as HIP or hot extrusion. This leads to a very high production cost. On the other hand, the roll method that brings about rapid solidification can be applied only to the production of thin tape (about 100μm), and it cannot be applied to the production of thick sheet for sheet working and isothermal forging. Therefore, the application of superplasticity has been extremely limited.

Conventional nickel-base alloys (such as IN 100 which exhibit superplasticity have a hardness of about Hv 450 if they undergo precipitation hardening without work hardening after solution treatment. This hardness is not sufficient for them to be used as ornamental hard alloys. To make the alloy convert into an ornamental hard alloy having a hardness of about Hv 600 by precipitation hardening, it should undergo cold working such as sizing after superplasticity working, because superplasticity is abnormal ductility accompanied by work softening and superplasticity does not increase hardness. For this reason, superplastic working is only possible to near netshape, and it has been impossible to apply the transcription ability, which is one of the characteristic properties of superplasticity, to the nickel-base alloy of precipitation hardening type.

In addition, a disadvantage of nickel-base alloys containing nickel 58–72%, chromium 25–35%, and aluminum 3.0–7.0% is that they are capable of deformation in their solution state but they have a high deformation stress. This makes it necessary to install a large equipment for forming of complicated objects such as a watch case, except forming of simple plates and rods. An additional disadvantage is that the solid solution temperature of the precipitation phase is about 1000° C. If the hot working is performed at a temperature lower than that, cracking caused by the presence of precipitates is liable to occur at the precipitate. If the hot working is performed at a temperature higher than that, grains grow so rapidly that hot working is difficult to carry out.

SUMMARY OF THE INVENTION

It is the primary object of the present invention to provide a thermomechanical treatment by which the above-mentioned defects of the conventional technique are overcome to thereby obtain a hard ornamental alloy which is able to exhibit superplasticity.

Another object of the invention is to provide an improved hot working which is able to utilize the superplasticity for the reduction of production cost and for the good transcription ability and diffusion bonding ability which contribute to diversified design.

In accordance with the present invention, there is provided a thermomechanical treatment comprising subjecting a nickel-base alloy to cold working, warm working or both workings to a working reduction of 35% or above prior to hot working.

DESCRIPTION OF THE PREFERRED EMBODIMENTS

Figure 1:
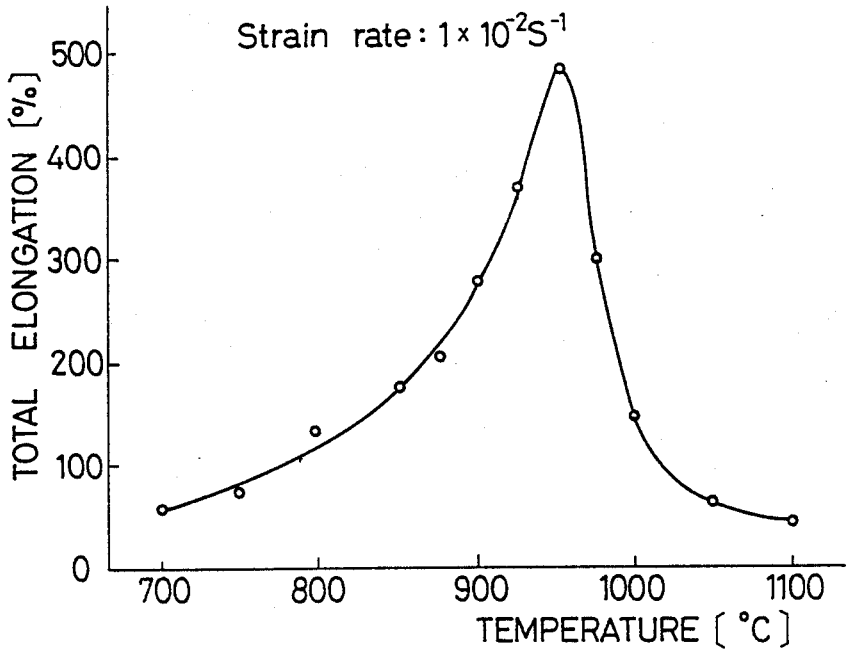
FIG. 1 is a graph in which the total elongation of Spe. B cold-rolled to 90% reduction is plotted against the hot working temperature, with the strain rate kept constant at $1\times10^{-2}S^{-1}$, where Spe. B is a specimen which is as-solution-treated.

According to the present invention, the above-mentioned disadvantages are overcome by introducing superplasticity into an alloy which can be hardened by aging after solution treatment. That is, the gist of the invention resides in a process for forming a nickel-base alloy which comprises subjecting a nickel-base alloy containing nickel 58–72%, chromium 25–35%, and aluminum 3.0–7.0% to cold working or warm working or both to a working reduction of 35% or above prior to hot working which is performed at 800° to 1000° C. at a strain rate of from $10^{-5}S^{-1}$ to $10^{0}S^{-1}$. In this way, the alloy is caused to exhibit its superplasticity that permits large deformation under a low stress.

The nickel-base alloy containing nickel 58–72%-chromium 25–35%, and aluminum 3.0–7.0% forms a precipitation phase in the matrix γ phase. It consists of a γ′ phase and an α phase at 920° C. or below and an α phase at 920° C. or above. The γ′ phase is an intermetallic compound of $Ni_3Al$ and the α phase is a solid solution of chromium.

The α phase in the precipitation phase precipitates in lamella form after hot rolling or solution treatment. This is not the case when the alloy undergoes cold working or warm working prior to precipitation treatment. In such a case, the heating in the hot working provides the precipitation phase in spherical form, and both the matrix phase and precipitation phase become equiaxed and fine-grained at a temperature above the recrystallization temperature, exhibiting the dual-phase fine grain structure. The grain size tends to be smaller as the degree of working increases.

As the alloy undergoes grain refinement, it exhibits the superplasticity in which grains shift from one position to another while rotating during hot working, thereby producing ductility.

The invention will be described in more detail with reference to the following examples.

EXAMPLE 1

A 5.5 mm thick hot-rolled material having a chemical composition as shown in Table 1 was used.

TABLE 1

| (wt %) | | |
|---|---|---|
| Cr | Al | Ni |
| 29.97 | 5.27 | Balance |

A portion of the hot-rolled 5.5 mm thick plate of nickel-base alloy was ground to a certain thickness which is adequate for the plate to be finally rolled into a 1.0-mm thick plate. The remainder of the hot-rolled 5.5 mm thick plate was cold-rolled to the same thickness, followed by solution treatment for 1 hour. In this way, there were obtained two kinds of specimens, Spe. A which underwent hot rolling alone, and Spe. B which underwent solution treatment. These specimens were cold-rolled at a prescribed rolling reduction until the final thickness of 1.0 mm was reached. From the thus obtained 1.0-mm thick plate were cut tensile test pieces, with the tensile axis parallel to the rolling direction. Incidentally, the cold rolling was performed at room temperature (20° C.).

The tensile test pieces were subjected to high-temperature tensile testing (hot working) using an Instron-type tensile tester in vacuum at 700°-1100° C. at a strain rate of $1\times{}^{-5}S^{-1}$ to $1\times10^{0}S^{-1}$. The total elongation and maximum flow stress of the test pieces were measured. Tables 2 and 3 show the results obtained when the hot-working temperature was 950° C. and the strain rate was $1\times10^{-2}S^{-1}$.

TABLE 2

| Test pieces obtained from Spe. A by cold rolling | | |
|---|---|---|
| Reduction (%) | Total elongation (%) | Maximum flow stress (MPa) |
| 10 | 90 | 115 |
| 35 | 100 | 110 |
| 50 | 320 | 78 |
| 70 | 490 | 65 |

TABLE 3

| Test pieced obtained from Spe. B by cold rolling | | |
|---|---|---|
| Reduction (%) | Total elongation (%) | Maximum flow stress (MPa) |
| 10 | 85 | 125 |
| 35 | 90 | 120 |
| 50 | 280 | 85 |
| 70 | 430 | 68 |
| 90 | 480 | 64 |

EXAMPLE 2

The same specimens Spe. A and Spe. B as used in Example 1 were subjected to warm rolling at 200°-500° C. until the final thickness of 1.0 mm was reached. From this rolled sample were cut test pieces, with the tensile axis parallel to the rolling direction. In the case of warm rolling at 500° C. or above, it was difficult to perform rolling to a rolling reduction of 30% or more on account of the precipitation of hard secondary phase.

The tensile test pieces were subjected to high-temperature tensile test (hot working) using an Instron-type tensile tester in vacuum under the same conditions as in Example 1. Tables 4 and 5 show the results obtained when the hot-working temperature was 950° C. and the strain rate was $1\times10^{-2}S^{-1}$.

TABLE 4

| Test pieces obtained from Spe. A by warm rolling | | | | | | |
|---|---|---|---|---|---|---|
| Properties | Total elongation (%) | | | Maximum flow stress (MPa) | | |
| Rolling temp. °C. | 200 | 300 | 400 | 200 | 300 | 400 |
| Reduction, 10% | 85 | 83 | 75 | 120 | 128 | 138 |
| Reduction, 35% | 105 | 90 | 80 | 118 | 120 | 130 |
| Reduction, 50% | 260 | 250 | 250 | 72 | 70 | 78 |
| Reduction, 70% | 420 | 400 | 390 | 68 | 68 | 72 |
| Reduction, 90% | 450 | 440 | 410 | 65 | 65 | 68 |

TABLE 5

| Test pieces obtained from Spe. B by warm rolling | | | | | | |
|---|---|---|---|---|---|---|
| Properties | Total elongation (%) | | | Maximum flow stress (MPa) | | |
| Rolling temp. °C. | 200 | 300 | 400 | 200 | 300 | 400 |
| Reduction, 10% | 85 | 80 | 80 | 138 | 148 | 155 |
| Reduction, 35% | 80 | 80 | 80 | 130 | 138 | 145 |
| Reduction, 50% | 230 | 200 | 200 | 90 | 95 | 100 |
| Reduction, 70% | 350 | 350 | 320 | 80 | 83 | 87 |
| Reduction, 90% | 420 | 390 | 375 | 70 | 75 | 78 |

EXAMPLE 3

The same specimens Spe. A and Spe. B as used in Examples 1 and 2 were subjected to warm rolling at 200°-500° C. and then cold rolling (at room temperature) until the final thickness of 1.0 mm was reached. From this rolled sample were cut test pieces, with the tensile axis parallel to the rolling direction.

The tensile test pieces were subjected to high-temperature tensile testing (hot working) using an Instron-type tensile tester in vacuum under the same conditions as in Examples 1 and 2. Tables 6 and 7 show the results obtained when the warm-rolling temperature was 400° C. and the hot-working temperature was 950° C. and the strain rate was $1\times10^{-2}S^{-1}$.

TABLE 6

| Test pieces obtained from Spe. A by warm rolling and cold rolling | | | |
|---|---|---|---|
| Reduction (%) of warm rolling | Reduction (%) of cold rolling | Total elongation (%) | Maximum flow stress (MPa) |
| 20 | 20 | 300 | 80 |
| 60 | 60 | 420 | 70 |
| 80 | 60 | 510 | 65 |

TABLE 7

| Test pieces obtained from Spe. B by warm rolling and cold rolling | | | |
|---|---|---|---|
| Reduction (%) of warm rolling | Reduction (%) of cold rolling | Total elongation (%) | Maximum flow stress (MPa) |
| 20 | 20 | 250 | 85 |
| 60 | 60 | 400 | 70 |
| 80 | 60 | 450 | 68 |

It is noted from Tables 2 to 7 that the total elongation in hot working is not significant so long as the total reduction is less than 35% in cold rolling or warm rolling or both, but it significantly increases when the total reduction exceeds 35%. The results shown above indicate that it is possible to perform warm rolling, extrusion, and other working so long as the rolling temperature is lower than the recrystallization temperature and working reduction is less than 35%.

FIG. 1 is a graph in which the total elongation of Spe. B cold-rolled to 90% reduction is plotted against the hot working temperature, with the strain rate kept constant at $1\times10^{-2}S^{-1}$, where Spe. B is specimen which is as-solution-treated. It is noted that the total elongation is less than 100% (insufficient) when the hot working temperature is lower than 800° C. and higher than 1000° C. This is the reason why the hot working temperature should be in the range of 800° to 1000° C. according to the present invention.

Figure 2:
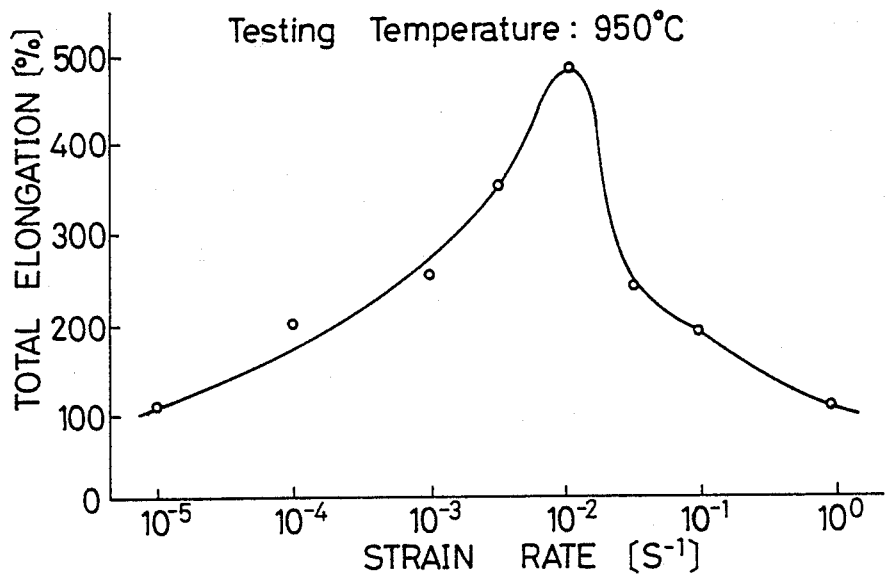
FIG. 2 is a graph in which the total elongation of Spe. B cold-rolled to 90% reduction is plotted against the strain rate, with the hot working temperature kept constant at 950° C., where Spe. B is a specimen which is as-solution-treated.

FIG. 2 is a graph in which the total elongation of Spe. B cold-rolled to 90% reduction is plotted against the strain rate, with the hot working temperature kept constant at 950° C., Spe. B is the same specimen as FIG. 1. It is noted that the total elongation is greater than 100% when the strain rate is in the range of $10^{-2}S^{-1}$ to $10^{-0}S^{-1}$. This is the reason why the strain rate in hot working should be $10^{-5}S^{-1}$ to $10^{0}S^{-1}$ according to the present invention. It is further noted from FIGS. 1 and 2 that the working temperature of 950° C. and the strain rate of $1\times10^{-2}S^{-1}$ are the optimum working conditions for the sample which has undergone cold rolling of 90% reduction after solution treatment.

As mentioned above, according to the present invention, it is possible to permit a precipitation hardened nickel-base alloy of high corrosion resistance to exhibit superplasticity at the time of hot working by subjecting the alloy to extremely simple pretreatment. Therefore, the alloy has a much greater total elongation and extremely smaller flow stress than that which underwent hot working in the conventional manner. Consequently, not only does the present invention contribute to a great cost reduction, but it also permits diversified designs owing to the transcription ability and diffusion bonding ability. In addition, the process of the present invention enables rolling at a high reduction and provides a thin metal tape. This thin metal tape may be interposed between identical or different materials for their bonding. This technology makes it possible to bond metal to metal or metal to ceramics by utilizing the alloy's high deformability and diffusion bonding ability.

What is claimed is:

1. A method for working a nickel-base alloy, comprising: subjecting a nickel-base alloy consisting essentially of nickel 58–72%, chromium 25–35% and aluminum 3.0–7.0% to cold working, warm working or both workings at a working reduction of 35% or above prior to hot working.

2. A method for working a nickel-base alloy as claimed in claim 1;

wherein the hot working is performed at a temperature in the range of 800° to 1000° C.

3. A method for working a nickel-base alloy as claimed in claim 2;

wherein the hot working is performed at a strain rate of from $10^{-5}S^{-1}$ to $10^{0}S^{-1}$.

4. A method for working a nickel-base alloy as claimed in claim 1;

wherein the cold working is carried out at room temperature.

5. A method for working a nickel-base alloy as claimed in claim 1;

wherein the warm working is carried out at a temperature in the range of 200° to 500° C.

6. A method for working a nickel-base alloy as claimed in claim 1; wherein the hot working is performed at a strain rate of from $10^{-5}S^{-1}$ to $10^{0}S^{-1}$.

7. A nickel-base alloy consisting essentially of nickel 58–72%, chromium 25–35% and aluminum 3.0–7.0% and worked according to the method of claim 1.

* * * * *